United States Patent [19]

Nakagawa et al.

[11] Patent Number: 4,514,459

[45] Date of Patent: Apr. 30, 1985

[54] WOVEN FABRIC HAVING A VELVETY APPEARANCE

[75] Inventors: Junyo Nakagawa; Shinji Yamaguchi; Kiyoshi Hirakawa, all of Kurashiki; Isao Tokunaga, Okayama; Masaaki Ito, Saijo, all of Japan

[73] Assignee: Kuraray Co., Ltd., Kurashiki, Japan

[21] Appl. No.: 613,225

[22] Filed: May 23, 1984

[30] Foreign Application Priority Data

Jun. 2, 1983 [JP] Japan ..... 58-99069

[51] Int. Cl.[3] ..... D03D 3/00

[52] U.S. Cl. ..... 428/229; 8/147; 8/529; 428/245; 428/257

[58] Field of Search ..... 428/229, 230, 245, 257, 428/260, 373, 374, 397, 400; 8/529, 147; 28/160, 163

[56] References Cited

U.S. PATENT DOCUMENTS 2,443,711 6/1948 Sisson ..... 264/188
4,059,949 11/1977 Lee ..... 428/229
4,468,434 8/1984 Sekimoto et al. ..... 428/373

FOREIGN PATENT DOCUMENTS 147862 5/1977 Japan ..... 428/229
115146 12/1981 Japan ..... 428/229

*Primary Examiner*—James J. Bell
*Attorney, Agent, or Firm*—Oblon, Fisher, Spivak, McClelland & Maier

[57] ABSTRACT

The invention relates to a woven fabric and more particularly to a woven fabric having a velvety appearance. At least either warp yarns or weft yarns in the fabric comprise conjugate fibers having a cross sectional configuration such that the flatness is 3.5–15.0. Conjugate fibers representing more than 35% by weight of the conjugate fiber content of the fabric at portions other than formation points of the fabric have an angle of inclination of 45°–90° relative to the surface of the fabric. The floating distance between the formation points of the fabric covers a length of more than $\frac{1}{4}$ of the pitch of the twist in the conjugate fiber.

8 Claims, 9 Drawing Figures

FIG. 1a
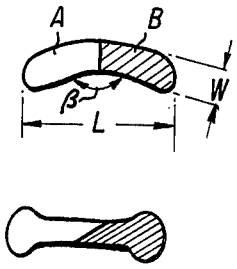
FIG. 1b
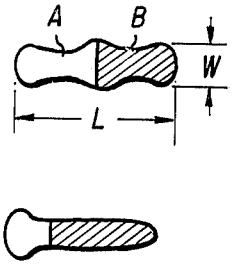
FIG. 1c
FIG. 1d
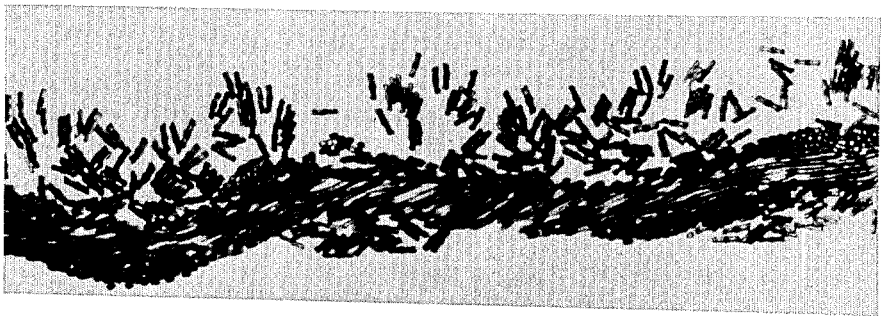
FIG. 2
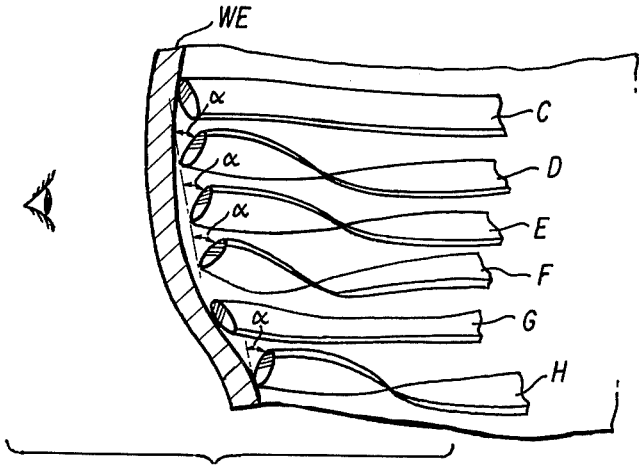
FIG. 3

WOVEN FABRIC HAVING A VELVETY APPEARANCE

FIELD OF THE INVENTION

This invention relates to woven fabrics and not to knitted fabrics. More specifically, the invention is intended to provide a woven fabric having a velvety appearance, without having loop piles or cut piles on to the fabric, and further having excellent bulkiness. The present inventor has developed a woven fabric having a velvety appearance and excellent bulkiness by using flat conjugate fibers having a specific flatness in cross section as yarn components representing at least either warp yarns or weft yarns of the fabric.

DESCRIPTION OF THE PRIOR ART

U.S. Pat. No. 2,443,711 discloses that a certain side-by-side type conjugate fiber has 5–50 crimps per inch and that fabrics produced by using the fiber have a wool-like appearance. However, this U.S. patent contains no disclosure as to a conjugate fiber having such high flatness of 3.5–15.0 as discovered in the present invention. Nor does it disclose such state of inclination of conjugate fibers in the fabric structure or such floating distance between formation points or such pitch of twist in the conjugate fibers as defined in this invention.

MAN-MADE FIBERS, H. MARK ET AL, 375 (1967) deals with conjugate fibers: in page 379, Dr. Braunlich reports that a viscose conjugate fiber has random three dimensional crimps and can give bulkiness to fabrics, and in page 380, Dr. Hicks et al report that Orlon (DuPont's trademark for its acrylic fiber) conjugate fiber has random three-dimensional crimps and can give wool-like effects to the fabrics. As is the case with aforesaid U.S. Pat. No. 2,443,711, this publication contains no disclosure as to the features of the present invention.

TEXTILE RESEARCH JOURNAL, Vol. 32, 39 (1962) also introduces Orlon conjugate fibers, discussing crimp mechanism. However, it does not disclose the features of the present invention, either.

SUMMARY OF THE INVENTION

This invention relates to a woven fabric having a velvety appearance and excellent bulkiness, without having loop piles or cut piles on to the fabric.

The constructional features of such fabric according to the invention lie in three points as mentioned below:

1. At least either warp yarns or weft yarns in the fabric comprise flat conjugate fibers having a cross sectional configuration such that the flatness L/W (where L: maximal length of the cross section, and W: maximal width of the cross section) is 3.5–15.0 and the bending angle is 180°–150° and having two kinds of polymers, one different from the other in shrinking percentage in boiling water by more than 2%, conjugating in side-by-side relation in the widthwise direction of the cross section, and the flat conjugate fiber content being more than 20% by weight relative to the entire warp and weft yarns constituents.

2. In every section of the fabric as cut parallel to the warp or weft yarns thereof, individual conjugate fibers representing more than 35% by weight of the conjugate fibers content of the fabric, other than the conjugate fibers present at formation points of the fabric, have a cross sectional configuration inclined relative to the surface of the fabric at the angle of inclination ($\alpha$) being 45°–90°.

3. The floating distance between the formation points of the fabric covers a length of more than $\frac{1}{4}$ of the pitch of the twist (P) in the conjugate fiber.

BRIEF DESCRIPTION OF THE DRAWINGS

FIG. 1 is a schematic view showing a few examples of flat conjugate fibers as used in the present invention: flatness is represented by L/W and bending angle by $\beta$. As can be clearly seen, polymers A, B are conjugated in side-by-side relation in the widthwise direction of flat conjugate fiber.

The fiber of FIG. 1(*a*) has substantially the same width along its length except just before each end where the width diminishes to a point.

The fiber of FIG. 1(*b*) has a width which, in proceeding from one end to another, varies so that the fiber has wide portions at each end and a third wide portion adjacent the middle of its length.

The fiber of FIG. 1(*c*) is similar to that of FIG. 1(*b*) except that it only has wide portions at each end of the fiber.

The fiber of FIG. 1(*d*) has only one wide end, which is at the end of the fiber composed of polymer A.

FIG. 2 is a microscopic view (×180) of a section of a fabric according to the invention as cut parallel to the weft yarns, with a cross section showing the way in which flat conjugate fibers used as warp yarns are present in the fabric.

FIG. 3 is a fragmentary schematic view of the fabric in FIG. 2, the fabric being shown as cut parallel to weft yarn WE. Characters C, D, E, F, G and H denote warp yarns comprising flat conjugate fibers. As shown, fibers represented by warp yarns D, E, F and H, each has a cross section inclined at angle of inclination $\alpha$ relative to the surface of the fabric, whereas fibers represented by warp yarns C and G have a cross sectional configuration substantially parallel to the surface of the fabric.

Figure 4:
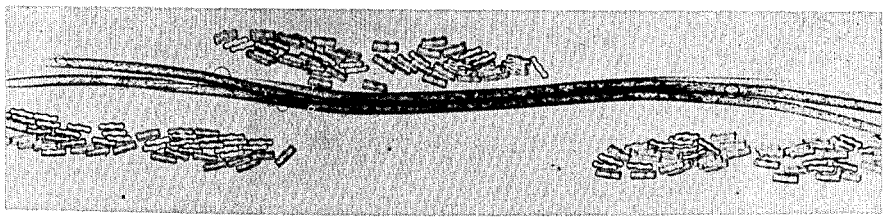

FIG. 4 is a microscopic view (×180) of a section of a fabric which is outside for the scope of the invention. As shown, every flat conjugate fiber used as warp yarn has a cross sectional configuration substantially parallel to the surface of the fabric.

Figure 5:
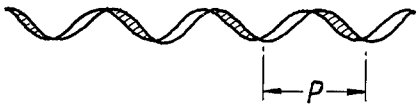

FIG. 5 is a schematic view showing one filament in which flat conjugate fibers according to the invention are in twisted state. The distance (length) from a bottom of twist to an adjacent bottom of twist is herein defined as pitch of the twist (P) in conjugate fiber.

Figure 6:
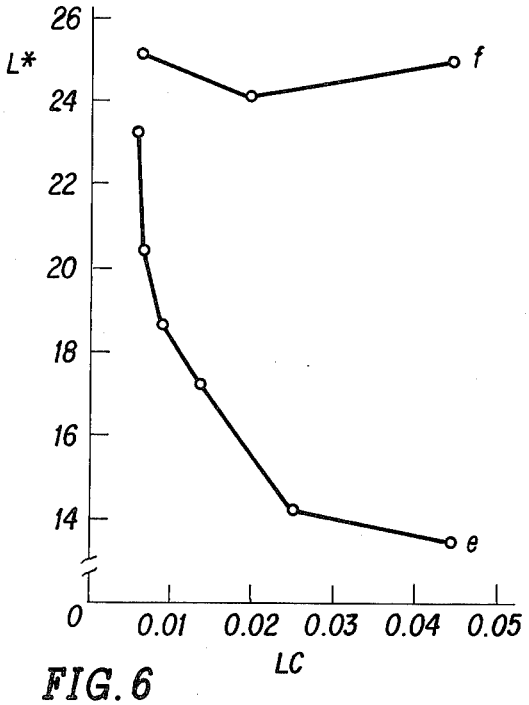

FIG. 6 shows the relation of floating distance between the formation points of fabric (LC) with depth of color (L*) of dyed fabric. It can be seen that the smaller the L*, the deeper is the color tone of the dyed fabric. In the figure, e shows LC-L* relationship in a dyed fabric in which flat conjugate fibers according to the invention, with a pitch of twist (P) of 0.025, are used as warp yarns; and f shows a similar relation with respect to a dyed fabric in which flat fibers different from the conjugate fibers of the invention are used as warp yarns, said fibers being of single-polymer type and having no twisting property.

DETAILED DESCRIPTION OF THE INVENTION

The present invention relates to woven fabrics having a velvety appearance and excellent bulkiness without having loop piles or cut piles on to the fabric. In particular, it is directed to such fabrics having a relatively small thickness, of the order of about 0.2–1 mm, and not so thick as velvets which normally have a thickness of the order of 2–5 mm.

As well known, velvet is a thick fabric having loop piles or cut piles on to the fabric. A dyed velvet has a depth of color such that even when the fabric is laid flat as it is, the depth of color varies according to the direction of sight. A dress or suit made from such fabric, when worn, exhibits a delicate silihouette effect. As such, velvet is said to be a high class fabric. The present inventor calls such phenomenon a velvety appearance. On the other hand, because of its thickness, velvet is limited in its uses, for example, to dress and suits for late autumn or winter wear. In view of this fact, the present inventor contemplated to produce a woven fabric, comparatively thin, say, of the order of 1 mm or less in thickness, which is suitable for wear in spring, summer and early autumn, and more particularly, such woven fabric having no loop piles or cut piles on to the fabric and having a velvety appearance and excellent bulkiness.

The understanding of the inventor as to the mechanism for producing aforesaid velvety appearance is as follows. A dyed velvet as laid flat as it is appears to have a deep and lustrous color. This may be explained by the fact that since the velvet has loop piles or cut piles which stand substantially vertically on the surface of the fabric, light beams incident on the piles are reflected between the adjacent piles and/or absorbed into spaces between the piles so that little colorless light is visible to the naked eye. Now, if a dyed velvet is pleated or has curved surfaces, light beams incident on the pleats or the curved surfaces are seen in a white color tone and thus a so-called silhouette effect is produced. The reason for this phenomenon is that in the pleated velvet, loop piles or cut piles lie on the fabric surface and accordingly light beams irradiated on the sides of the piles are directly visible to the naked eye in the form of colorless reflected light. One can observe a velvety appearance based on the abovementioned two aspects of mechanism, when he wears a dyed velvet garment. Then, in order to give a velvety appearance to woven fabrics having no piles, the inventor conducted a research into a fabric construction such that light beams incident on the fabric may be reflected between adjacent fibers and/or absorbed into spaces between adjacent fibers and further such that where the fabric has curved surfaces or pleats, larger proportions of light beams incident on them may be reflected in colorless light and the research efforts have led to the present invention.

The woven fabric according to the invention must meet the following three conditions:

1. At least either warp yarns or weft yarns in the fabric comprise flat conjugate fibers having a cross sectional configuration such that the flatness L/W (where L: maximal length of the cross section, and W: maximal width of the cross section) is 3.5–15.0 and the bending angle is 180°–150° and having two kinds of polymers, one different from the other in shrinking percentage in boiling water by more than 2%, conjugating in side-by-side relation in the widthwise direction of the cross section, and the flat conjugate fiber content being more than 20% by weight relative to the entire warp and weft yarns constituents.

2. In every section of the fabric as cut parallel to the warp or weft yarns thereof, individual conjugate fibers representing more than 35% by weight of the conjugate fiber content of the fabric, other than the conjugate fibers present at formation points of the fabric, have a cross sectional configuration inclined relative to the surface of the fabric at the angle of inclination ($\alpha$) being 45°–90°.

3. The floating distance between the formation points of the fabric covers a length of more than $\frac{1}{4}$ of the pitch of the twist (P) in the conjugate fiber.

The conditions 1–3 will now be explained.

Condition 1

For either warp yarns or weft yarns, or both warp and weft yarns in the woven fabric of the invention are used conjugate fibers as described below. All the constituent fibers of the yarns or a portion of them may be conjugate fibers, but the quantity of conjugate fibers used must be more than 20% by weight relative to the entire warp and weft yarns. Otherwise, the object of the invention, that is, velvety appearance and excellent bulkiness cannot be attained. A preferred quantity of conjugate fibers to be used for the purpose of the invention is 40 weight % or more relative to the entire warp and weft yarn requirements. The conjugate fibers according to the invention may be used as warp or weft yarns in filament form and in alternate relation with other kinds of fiber yarns. They may be doubled or twisted with other kinds of fibers into warp or weft yarns. Further, they may be blended in staple form with other kinds of staple fibers into warp or weft yarns.

A few examples of conjugate fibers suitable for the purpose of the invention are shown in FIG. 1. According to the invention, a suitable conjugate fiber has a sectional configuration such that the flatness (L/W) is 3.5–15.0 and the bending angle 180°–150°. As a conjugate fiber, it is flat and substantially linear. Further, the flat conjugate fiber according to the invention is such that two kinds of polymers A, B, each different from the other in shrinking percentage in boiling water by more than 2%, are conjugated in side-by-side relation in the widthwise direction of the cross section. The term "shrinking percentage in boiling water" referred to above is defined as a shrinking percentage measured when individual fiber formed respectively of polymers A and B, after being subjected to drawing on a hot plate at 120° C. and at draw ratio of 0.68 time to their respective maximum draw ratio, are treated in boiling water for 10 minutes. It is essential that there must be a difference of more than 2% in shrinking percentage between the two kinds of drawn fibers A and B. Otherwise, no sufficient twist will develop in the fibers, even if they, as a conjugate fiber, have an L/W of 3.5–15.0, and the object of the invention cannot be achieved. Available as polymers A, B are polyester, polyamide, polyolefine, polyetherester, polyacrylonitrile, polyvinyl-alcohol, cellulose, and the like. Among these, polyester and polyamide are preferred in particular. More preferably, a conjugate fiber is formed of two types of polyesters having different shrinking properties.

By way of examples, preferred combinations of polymers, as polymers A, B, are shown below. Most preferred among those shown are combinations (iii) and (v).

(i)

Polymer A: polyethylene terephthalate (PET), with $[\eta] \geqq 0.6$.

Polymer B: PET with $[\eta]$ smaller than that of polymer A by more than 0.1.

(In this instance, the difference between the drawn fibers of each polymer A and B in shrinking percentage in boiling water = ΔWSr is about 3–5%.)

(ii)

Polymer A: polybutylene terephthalate (PBT), with $[\eta] \geqq 0.75$ or more.

Polymer B: PBT with $[\eta]$ smaller than that of polymer A by more than 0.1.

(ΔWSr is about 3–10%.)

(iii)

Polymer A: PET, not substantially copolymerized with a third component.

Polymer B: PET, copolymerized with 3–15 mol % of a third component.

(ΔWSr is about 3–10%.)

(iv)

Polymer A: PBT, not substantially copolymerized with a third component.

Polymer B: PBT, copolymerized with 3–15 mol % of a third component.

(ΔWSr is about 3–10%.)

(v)

Polymer A: PET

Polymer B: PBT (ΔWSr is about 3–5%.)

(vi)

Polymer A: PET

Polymer B: Polymer blend of PET and PBT.

(ΔWSr is about 3–5%.)

The term "not substantially copolymerized with a third component" means that PET or PBT in copolymerized with less than 2 mol % of a third component, such as, for example, isophthalic acid, adipic acid, sebatic acid, diethylene glycol, neopenthyl glycol, sulpho-isophthalic acid, or 1,4-butane diol, or contains less than 2% by weight of additives.

For the purpose of the present invention, a flatness (L/W) of 3.5–15.0 is a necessary condition for conjugate fibers. Where the flatness is less than 3.5, the object of the invention cannot be achieved, even if other conditions are within the scope of the invention. Where the flatness is in excess of 15.0, a cross section of the fiber becomes substantially parallel to the surface of the fabric, and therefore, the object of the invention cannot be achieved. A preferred range of flatness is 4–8, and the optimum range is 4.5–6.5. In the present invention, flatness (L/W) is a value arrived at by dividing the maximal length L of a flat cross section by the maximal width W thereof, as represented by fiber b in FIG. 1. The L/W of flat conjugate fibers explained as yarns are defined as a mean value of L/W measurements made of at least 20 of such fibers.

In order to produce a velvety appearance, it is necessary that the flat conjugate fiber has a substantially linear flat cross section such that the bending angle ($\beta$) as represented by fiber a in FIG. 1 is 180°–150°. If the bending angle is less than 150°, a velvety appearance cannot be obtained, even when the condition 2 to be explained hereinafter, i.e., the requirement that the angle of inclination be 45°–90° is satisfied.

The flat conjugate fiber according to the invention has little twist before it is heat treated, but once it is heat treated, a twist effect develops in the fiber as can be seen from FIG. 5.

A preferred cross sectional configuration of such conjugate fiber is of a dog-bone type having wide portions at both ends of the cross section, as can be seen with fibers b and c in FIG. 1. More preferably, the cross sectional configuration is such that the fiber has another wide portion adjacent the middle of its length, as seen with fiber b in FIG. 1. A flat conjugate fiber having wide portions at both ends and also at middle portion of its cross section is particularly advantageous in that reflection of light beams incident on the fiber can be relieved.

The flat conjugate fibers according to the invention may be produced by a known process. A spinning velocity range of about 500–6,000 m/min may be employed. Fibers spun are then drawn at 0.6–0.7 time to the maximum draw ratio on a heated plate, for example.

Condition 2

The woven fabric of the invention has no loop piles or cut piles on to the fabric. It may be satin, taffeta, twill, shadow fabric, or double cloth, for example.

The fabric of the invention must be such that if it is cut parallel to the warp or weft yarns, individual conjugate fibers representing more than 35% by weight of the conjugate fibers content of the fabric, other than the conjugate fibers present at formation points of the fabric, have a cross section inclined relative to the surface of the fabric, the angle of inclination ($\alpha$) being 45°–90°. Needless to say, in no case the angle of inclination ($\alpha$) exceeds 90°. If $\alpha$ is less than 45°, the object of the invention, i.e., velvety appearance cannot be achieved. Even where $\alpha$ is within a 45°–90° range, if the proportion of conjugate fibers present within that range is less than 35% by weight, the object of the invention cannot be attained either. Where $\alpha$ is 45°–90° and where the proportion of conjugate fibers having an $\alpha$ of more than 70° is 50% by weight or more, the object of the invention can easily be achieved. At formation points of the fabric, the flat conjugate fibers are held down by warp or weft yarns, so that they are substantially parallel to the surface of the fabric. Therefore, for the purpose of measuring the angle of inclination ($\alpha$), conjugate fibers present at formation points of the fabric are excluded from consideration.

Condition 3

For the fabric of the invention it is essential that the floating distance between the formation points of the fabric covers a length of more than $\frac{1}{4}$ of the pitch of twist in the conjugate fiber, The term "floating distance between the formation points of the fabric (LC)" referred to herein means the distance from an intersecting point of warp yarns and weft yarns, that is, a formation point of the fabric to an adjacent formation point. The floating distance may be expressed in terms of inches, for example. The term "pitch of twist (P)" in the conjugate fiber may be explained by FIG. 5 in which the state of twist in one flat conjugate fiber (monofilament) is illustrated, "P" being designated as such. Pitch of twist is expressed in terms of inches/pitch, for example. To measure pitch of twist, the number of twists per inch is checked with respect to a conjugate fiber after heat treated at 180° C. for 5 minutes. Where the number of twists per inch = K, $P = 1/K$. In flat conjugate fibers used for the purpose of the invention, K is generally about 20–300.

In order that the dyed fabric of the invention may have good depth of color, $LC \geqq P \times \frac{1}{4}$, and more preferably, $LC \geqq P$.

FIG. 6 shows floating distance between the formation points of the fabric LC (unit: inch) on the abscissa axis, and depth of color of the dyed fabric L* (unit:

nothing) on the ordinate axis. In the figure, e represents experimental results on a dyed woven fabric using flat conjugate fibers having P of 0.025 inch according to the invention as warp yarns, and regular polyester fibers as weft yarns, while f represents experimental results on a dyed woven fabric in which single-polymer flat fibers primarily having no twisting property are used as warp yarns and regular polyester fibers are used as weft yarns. Both fabric e and f are same in fabric construction and dyeing conditions. As is apparent from FIG. 6, in the dyed fabric e of the invention, L* is about 20 where LC is about 0.006 (equal to about $\frac{1}{4}$ of P), the depth of the color being satisfactory anyhow. Where LC is about 0.025 (equal to P), L* value obtained (about 14 or less) is particularly preferable. Accordingly, the present inventor determined $LC \geqq P \times \frac{1}{4}$. In the comparative example of dyed fabric f, there can be seen no such relationship between LC and L* as is observed with fabric e.

EFFECT OF THE INVENTION

The fabric of the invention is a fabric which meets aforesaid conditions 1–3. Such fabric can be obtained in the following manner. A fabric in which flat conjugate fibers as specified by condition 1 are used at least either for warp yarns or for weft yarns is heat treated, wherein a fabric construction before heat treatment is easily determined so as to the fabric contruction after heat treatment may satisfy conditions 2 and 3. A person skilled in the art empirically know well what will be the degree of shrinkage of a fabric after heat treatment. For example, he knows that if a polyester woven fabric is heat treated, warp yarns of the fabric are subject to a shrinkage of about 3–8% and weft yarns are subject to a shrinkage of about 7–15%. The machine employed in heat treating the woven fabric of the invention may be of any known type. For example, machines such as relaxer, washer, loop dryer, pin tenter, and dyeing machine are available for use.

In this way, fabrics which can meet conditions 1–3 can be obtained with the aid of the technical common sense of persons skilled in the art. Further, it is possible to give excellent bulkiness to the fabric by treating such fabric in an aqueous solution of dilute alkali.

As is apparent from the Examples described hereinafter, the fabric of the invention has a velvety appearance L* and excellent bulkiness (expressed in terms of thickness of the fabric). In the fabric of the present invention, as TABLE 1 shows, velvety appearance L* is about 20 or less, and preferably about 14 or less, and where fabric construction is same, bulkiness is more than 0.3 mm, or preferably about 0.4 mm or more, in terms of thickness of the fabric. As can be clearly seen from TABLE 1, the fabric according to the invention is far much thinner than any conventional velvet, that is, its thickness is preferably about 0.3–0.5 mm, and it has a velvety appearance and excellent bulkiness.

EMBODIMENT OF THE INVENTION

Example 1

PET polymer A of which [$\eta$] (intrinsic viscosity as measured at 30° C. by using a 50:50 mixed solvent of phenol and tetrachloroethane) is 0.62, and PET polymer B copolymerized with 8 mol % of isophthalic acid and 2 mol % of sulfo-isophthalic acid were used in a conjugated ratio of 1:1, and a flat conjugate fiber having a cross sectional configuration as shown in FIG. 1(*b*) was obtained, wherein L/W=5.5, bending angle 180°, and 230d/24f. In this case, ΔWSr between polymers A and B was 7%. Subsequently, the fiber was subjected to two-stage drawing under the following conditions, and a drawn fiber of 75d/24f was obtained.

First roller: 77° C.
Second roller: 90° C.
Third roller: 25° C.
Draw ratio at first stage: 1.9
Draw ratio at second stage: 1.6

It was confirmed that the pitch of twist (P) in the fiber was 0.025 inch. By using this fiber as warp yarns, and regular polyester fiber having a circular cross-section of 50d/36f as weft yarns (weft density: 150/inch) was produced a satin weave, more particularly a single cycle of 3-counter, 5-end weft satin weave, the LC of the satin being $1/150 \times (5-1) = 0.027$ inch. The inventor expected that by forming this single cycle of 3-counter, 5-end weft satin weave having such fabric construction was it possible to produce a fabric which would satisfy conditions 2 and 3 after the satin weave being subjected to heat treatment.

The fabric was subjected to relaxer treatment (in boiling water at 98° C., 15 min.), heat bulking by long loop dryer (180° C.), heat setting (185° C.), dyeing (kind of the dye: Kayalon Polyester Black GS-F, Product of NIPPON KAYAKU CO., LTD), and final finishing treatment, in the order of mention, and a bulky satin weave was thus obtained.

The dyed satin had a thickness of about 0.42 mm, showing excellent bulkiness. Its L* value was 12.3 and exhibited a velvety appearance. Then, the dyed satin was cut parallel to the weft yarns in order to examine the angle of inclination ($\alpha$) to the surface of the satin of the flat conjugate fibers used as warp yarns. As a result of the examination, it was determined that 50 weight % of the conjugate fibers content of the fabric, other than the conjugate fibers present at formation points of the fabric had $\alpha$=75°–90°, 15 weight % had $\alpha$=65°–75°, and 35 weight % had $\alpha$=45° or below. Examples 2–5 and Comparatice Examples 1–6.

Flat conjugate fibers (Fiber No. X) having P=0.025 inch as used in Example 1, flat fibers of 75d/24f (Fiber No. Y) formed by PET polymer only and having L/W=5.8, and flat conjugate fibers of 75d/24f (Fiber No. Z) formed by polymer A, B as used in Example 1 and having L/W: 2.2 and P: 0.035 inch, were used as weft yarns respectively, and T-type cross section PET fibers was used as warp yarns, and thus various satin weaves were produced by varying fabric construction as shown in TABLE 1. These weaves were heat treated in same way as in Example 1. Fiber No. Y was a flat fiber, but was not a conjugate fiber. As such, it had no twisting property. Therefore, measurement of P could not be made.

TABLE 1

| Experiment | Weft yarns | LC | LC/P | L* | Thickness of the fabric[1]* | Section of the fabric[2]* |
|---|---|---|---|---|---|---|
| Comp. Ex 1 | X | 0.0055 | 0.22 | 23.3 | 0.28 | x |
| Comp. Ex 2 | Y | 0.007 | — | 25.2 | 0.11 | x |
| Comp. Ex 3 | Z | 0.012 | 0.34 | 22.2 | 0.17 | Δ |
| Example 2 | X | 0.0063 | 0.25 | 20.5 | 0.31 | Δ |
| Example 3 | X | 0.0085 | 0.34 | 17.9 | 0.32 | o |
| Comp. Ex 4 | Y | 0.020 | — | 24.2 | 0.18 | x |

TABLE 1-continued

| Experiment | Weft yarns | LC | LC/P | L* | Thickness of the fabric[1]* | Section of the fabric[2]* |
|---|---|---|---|---|---|---|
| Comp. Ex 5 | Z | 0.035 | 1.0 | 22.5 | 0.19 | Δ |
| Example 4 | X | 0.025 | 1.0 | 14.1 | 0.38 | ◎ |
| Example 5 | X | 0.045 | 1.8 | 13.2 | 0.41 | ◎ |
| Comp. Ex 6 | Y | 0.045 | — | 25.0 | 0.18 | x |

*[1]the thickness of the fabric under a pressure of 20 g/cm$^2$.
*[2]the cross section of the flat conjugate fibers substantially parallel to the surface of the fabric ($\alpha$ = 0°-10°).
Δ: 35-45 wt % of flat conjugate fibers inclined at 45°-90°.
o: 45-55 wt % of flat conjugate fibers inclined at 45°-90°.
◎: more than 55 wt % of flat conjugate fibers inclined at 45°-90°.

As is apparent from TABLE 1, in Examples 2-5, L* and thickness of the fabric shows improvement in proportion to the increase in LC, proving that the fabric of the invention exhibits a velvety appearance and excellent bulkiness. On the other hand, in the case of a single-polymer flat fibers having L/W=5.8, or flat conjugate fibers having a small L/W, e.g. 2.2, an increase in LC does not result in any improvement in L* or thickness of the fabric.

Example 6

PBT having $[\eta]=0.85$ was used as polymer A and PET having $[\eta]=0.55$ was used as polymer B (ΔWSr 4%) to obtain a flat conjugate fibers having L/W=5.0, and $\beta=165°$ as shown in FIG. 1(*a*). This fibers was drawn at a draw ratio of 2.5 into a drawn fiber of 75d/24f. The fibers was confirmed as having P of 0.019 inch.

By using this fiber as warp yarns, and regular polyester fibers having circular cross-section of 75d/48f as weft yarns was produced a 2/2 twill weave. The weft density of the twill was 95/inch, so LC was 0.021 inch. By using such fabric construction, it was expected that a subsequent heat treatment would make it possible to obtain a fabric which satisfies conditions 2 and 3. The twill was subjected to same heat treatment as in Example 1, except that the kind of dye used was Dianix Violet 5R-SE (Product of MITSUBISHI CHEMICAL INDUSTRIES LTD.)

The resulting dyed twill had a thickness of 0.35 mm and L*=15.7. Then, the dyed twill was cut parallel to the weft yarns, and the flat conjugate fibers used as warp yarns was examined as to angle $\alpha$. About 60 weight % of the conjugate fibers content of the fabric, other than the conjugate fibers present at formation points of the fabric had an inclination $\alpha$ of 45°-80°, and the rest showed an inclination $\alpha$ of below 45°. This dyed twill exhibited a velvety appearance and excellent bulkiness.

What is claimed is:

1. A dyed woven fabric having a velvety appearance and excellent bulkiness, characterized in that at least either warp yarns or weft yarns in the fabric comprise flat conjugate fibers having a cross sectional configuration such that the flatness L/W (where L: maximal length of the cross section, and W: maximal width of the cross section) is 3.5-15.0 and the bending angle is 180°-150° and having two kinds of polymers, one different from the other in shrinking percentage in boiling water by more than 2%, conjugating in side-by-side relation in the width-wise direction of the cross section, and the flat conjugate fibers content being more than 20% by weight relative to the entire warp and weft yarns constituents; in that in every section of the fabric as cut parallel to the warp or weft yarns thereof, individual conjugate fibers representing more than 35% by weight of the conjugate fibers content of the fabric, other than the conjugate fibers present at formation points of the fabric, have a cross sectional configuration inclined relative to the surface of the fabric at the angle of inclination ($\alpha$) being 45°-90°; and in that the floating distance between the formation points of the fabric covers a length of more than $\frac{1}{4}$ of the pitch of the twist (P) in the conjugate fiber.

2. A woven fabric according to claim 1 wherein the flatness is 4-8.

3. A woven fabric according to claim 2 wherein the flatness is 4.5-6.5.

4. A woven fabric according to claim 1 wherein the flat conjugate fibers have wide portions at both ends of a cross section thereof.

5. A woven fabric according to claim 4 wherein the flat conjugate fibers have wide portions at both ends of and adjacent the middle portion of a cross section thereof.

6. A woven fabric according to claim 1 wherein the proportion of conjugate fibers having an $\alpha$ value of more than 70° is more than 50% by weight.

7. A woven fabric according to claim 1 wherein $LC \geqq P \times \frac{1}{2}$.

8. A woven fabric according to claim 7 wherein $LC \geqq P$.

* * * * *